US008307598B2

(12) United States Patent
Holm et al.

(10) Patent No.: US 8,307,598 B2
(45) Date of Patent: Nov. 13, 2012

(54) INSULATING WALL SYSTEM FOR A BUILDING STRUCTURE

(75) Inventors: David Overton Charbre Holm, Smorum (DK); Preben Riis, Roskilde (DK)

(73) Assignee: Rockwool International A/S, Hedehusene (DK)

( * ) Notice: Subject to any disclaimer, the term of this patent is extended or adjusted under 35 U.S.C. 154(b) by 277 days.

(21) Appl. No.: 12/293,455

(22) PCT Filed: Mar. 29, 2007

(86) PCT No.: PCT/EP2007/002791

§ 371 (c)(1),
(2), (4) Date: Feb. 3, 2009

(87) PCT Pub. No.: WO2007/110244

PCT Pub. Date: Oct. 4, 2007

(65) Prior Publication Data

US 2009/0277119 A1 Nov. 12, 2009

(30) Foreign Application Priority Data

Mar. 29, 2006 (EP) ..... 06075764

(51) Int. Cl.
*E04B 2/28* (2006.01)

(52) U.S. Cl. ..... 52/506.05; 52/404.2

(58) Field of Classification Search ..... 52/DIG. 9, 52/745.09, 561, 562, 565, 568, 551, 506.05, 52/426, 404.2, 404.1; D25/121, 122, 123, D25/124, 125, 126, 127, 128, 129, 130, 131
See application file for complete search history.

(56) References Cited

U.S. PATENT DOCUMENTS

| | | | | |
|---|---|---|---|---|
| 3,950,912 | A * | 4/1976 | Lundberg et al. | 52/846 |
| 5,398,472 | A * | 3/1995 | Eichelkraut | 52/443 |
| 5,937,588 | A * | 8/1999 | Gard | 52/79.1 |
| 6,070,382 | A * | 6/2000 | Ettema | 52/404.4 |
| 6,205,740 | B1 * | 3/2001 | Ekerholm et al. | 52/846 |
| 6,718,712 | B1 * | 4/2004 | Heath | 52/309.12 |
| 7,461,486 | B2 * | 12/2008 | Black | 52/250 |
| D606,211 | S * | 12/2009 | Frobosilo | D25/125 |
| D618,365 | S * | 6/2010 | Crane | D25/121 |
| 8,074,416 | B2 * | 12/2011 | Andrews | 52/241 |
| 2001/0037622 | A1 * | 11/2001 | Gattas | 52/745.09 |

(Continued)

FOREIGN PATENT DOCUMENTS

CA 1205970 A * 6/1986

(Continued)

*Primary Examiner* — Basil Katcheves
*Assistant Examiner* — Rodney Mintz
(74) *Attorney, Agent, or Firm* — Gifford, Krass, Sprinkle, Anderson & Citkowski, P.C.

(57) ABSTRACT

The present invention concerns an insulating wall system for a building structure, wherein the wall system comprises a first wall having an exterior surface with insulation material attached to the exterior surface of the first wall by elongated fastening members extending through at least one wall member of a second wall and the insulation material and being fixed to the first wall, wherein the elongated fastening members are mounted substantially perpendicular to the exterior surface of the first wall and that the elongated fastening members are mounted pre-stressed with a predetermined amount of tension so that frictional forces between the insulation material and the exterior surface of the first wall and the inner surface of the second wall, respectively, are established. A wall system according to the invention includes fewer components and may provide an improved insulation as the components constituting thermal bridging may be reduced.

10 Claims, 5 Drawing Sheets

U.S. PATENT DOCUMENTS

| | | | | |
|---|---|---|---|---|
| 2002/0005023 | A1* | 1/2002 | Ford | 52/514 |
| 2003/0140588 | A1 | 7/2003 | Sucato | |
| 2004/0148889 | A1* | 8/2004 | Bibee et al. | 52/481.1 |
| 2004/0216404 | A1* | 11/2004 | Black | 52/250 |
| 2005/0284065 | A1* | 12/2005 | Shaffer | 52/404.1 |
| 2006/0283130 | A1* | 12/2006 | Andrews | 52/633 |
| 2007/0062140 | A1* | 3/2007 | Sillik | 52/404.1 |
| 2007/0175149 | A1* | 8/2007 | Bodnar | 52/481.1 |
| 2008/0104919 | A1* | 5/2008 | Riis et al. | 52/506.01 |
| 2008/0110126 | A1* | 5/2008 | Howchin | 52/630 |
| 2008/0250738 | A1* | 10/2008 | Howchin | 52/235 |
| 2009/0165410 | A1* | 7/2009 | Wuts | 52/302.1 |
| 2010/0115872 | A1* | 5/2010 | Holm et al. | 52/506.06 |
| 2012/0144765 | A1* | 6/2012 | LeBlang | 52/220.2 |

FOREIGN PATENT DOCUMENTS

| | | | |
|---|---|---|---|
| DE | 19703874 | A1 * | 8/1998 |
| DE | 202005002356 | U1 * | 6/2005 |
| EP | 191144 | A2 * | 8/1986 |
| EP | 1408168 | A1 * | 4/2004 |
| WO | WO 9935350 | A1 * | 7/1999 |
| WO | WO 2008128928 | A1 * | 10/2008 |

* cited by examiner

INSULATING WALL SYSTEM FOR A BUILDING STRUCTURE

The present invention relates to an insulating wall system for a building structure, wherein said wall system comprises a first wall having an exterior surface with insulation material attached to said exterior surface of said first wall by fastening members extending substantially perpendicular to the exterior surface through at least one support member of a second wall and the insulation material and being fixed to the first wall.

An insulating wall system of such kind is known from DE 197 03 874 A1. The insulating wall system disclosed therein is a vertical wooden outer wall structure of a building construction, where insulation slabs are fixed to the wooden inner wall by a number of support beams that are positioned on the outside of the insulation and secured to the inner wall by a number of screws penetrating through the insulation material with an angle of 60° to 80° relative to horizontal. A building facade is mounted on the support beams. Hereby, the screws can transfer the weight of the outer façade structure onto the inner wall, which is mounted on a building base structure.

This type of wall system is suitable for mounting of an outer wall insulation cover of existing building, but is limited to the amount of insulation material that can be mounted due to the required length of the screws.

However, in order to meet modern requirements to the insulation thickness of buildings, which may be up to 300 mm (11.8 inches) or more, it is difficult to design suitable screws that can penetrate the insulation layer in an inclined angle, as these must be exceptionally long and thereby difficult to handle and ensure that they are properly fastened onto the inner wall behind the insulation.

Further it is readily acknowledged in the building industry that the amount of penetrations of the insulation cover must be limited in order to avoid jeopardising the insulating effect of the insulation cover.

From EP 0 191 144 and WO 99/35350 examples of wall systems are disclosed wherein the insulation material is adhesively attached to the wall surface. This use of glue to attach the insulation to the wall may result in a reduction of attachment screws which penetrate the insulation and creates thermal bridges. However, these solutions are not suitable for a wall system wherein a relative thick insulation layer is required.

On this background, it is an object of the present invention to provide an insulated wall system which suitably allows for a relative thick insulation layer to be mounted and which is easy to mount.

This object is achieved by a wall system of the initially mentioned kind, wherein the substantially perpendicular fastening members are mounted pre-stressed with a predetermined amount of tension by compressing the insulation material so that frictional forces between the insulation material and the exterior surface of the first wall and between the insulation material and the inner surface of the support member, respectively, are established.

Hereby, frictional forces between the insulation member and the first wall and the second wall, respectively, are provided that are sufficient to transfer the weight of the second wall to the first wall exclusively by establishing a friction force between the insulation and the second wall and between the insulation and the first wall. According to the invention, the insulation material is utilised as an active component in the wall system.

By the term friction is meant the action of the surface of the support member and the insulation abutting each another.

Accordingly, the frictional forces are the resistance between the surface of the profile and the insulation preventing a relative movement there between. The frictional surface of the support member may comprise a rough surface structure and/or discrete minor compressions in the insulation surface, e.g. provided by separate protrusions provided on the surface of the support member.

By the invention, a wall system is provided which is easy to install and less time consuming to install compared to the known wall systems. The wall system according to the invention includes fewer components and may provide an improved insulation as the components constituting thermal bridging may be reduced.

One further advantageous of the invention is that it will be easy to adjust the exact position of the outer wall cover such that all cover elements of the outer wall are flush with each other. This can be done by increasing the pre-stress of the insulation member in selected areas.

According to the invention, the insulation material is compressed and thereby providing the pre-stressed mounting of the fastening members, said compression preferably being between 1.2% and 3.2%, and more preferably between 1.6% and 2.4%. According to a preferred embodiment, the predetermined tension is substantially twice the size of the required friction forces.

In a further preferred embodiment, the thickness and the resiliency of the insulation material are interrelated in such a way that for all thicknesses of the insulation material a compression with one specific force will give an impression in the insulation material of one and the same distance. This means that a thin insulation material must be relatively more resilient per mm, than a thicker insulation material.

In a preferred embodiment, the elongated fastening members are screws that preferably are horizontally orientated. By using suitably designed screws, the screws may be easy to mount with a predetermined tension. The screws may also be standardised screws which are mounted with a torque-limiting means to ensure the correct tension.

In the preferred embodiment, the insulation material includes at least one layer of insulation boards. The insulation material may be glass or stone fibres or any fibrous material, and also foam products such as EPS or XPS, or any combination of products may be applied. In particular, the insulation material is preferably mineral fibre boards, preferably having a density of 50 to 100 kg/m$^3$ (3.12-6.24 lb/ft$^3$), more preferably approx. 70 kg/m$^3$ (4.36 lb/ft$^3$). The insulation material may include two layers for providing extra thickness of the insulation.

In an embodiment of the invention, at least one of the insulation board layers may include dual density mineral fibrous boards. Hereby, the relation between friction and compression may be manipulated.

In the preferred first embodiment of the invention, the first wall is an inner wall and the second wall is an outer wall of the building structure. The second wall may preferably include one or more support members and a building cover structure mounted on said support beams. The inner wall may be a wooden structure or a concrete wall, lime stone wall or the like.

The support members may be wooden beams or metal profiles carrying a wooden building cover. Other cover materials may be fibre cement, compressed fibre materials, glass or metal, but preferably cover materials less than 5 cm (1.96 inch) in thickness. However other facade structures may be used.

By the invention, it is realised that the wall system according to the invention alternatively may be an internal wall of the building structure or that the first wall and the second wall constitutes a roof structure of the building structure.

In the following, the invention is described in more detail with reference to the accompanying drawings, in which.

Figure 3:
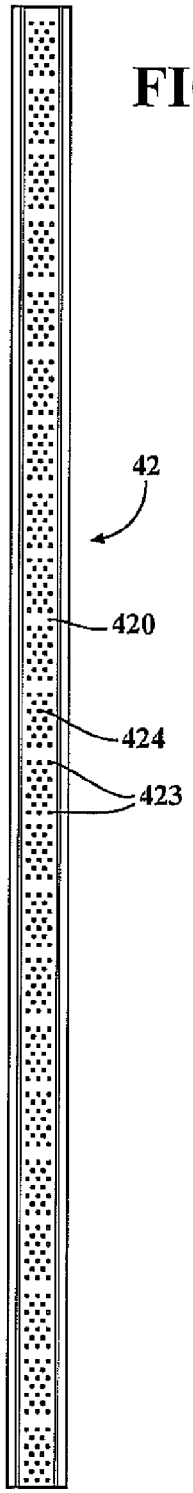
Figure 4:
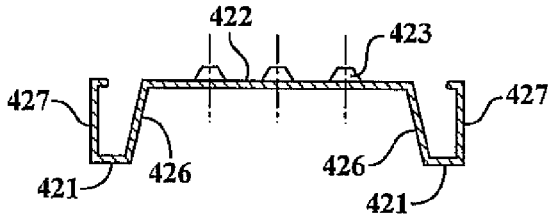
Figure 5:
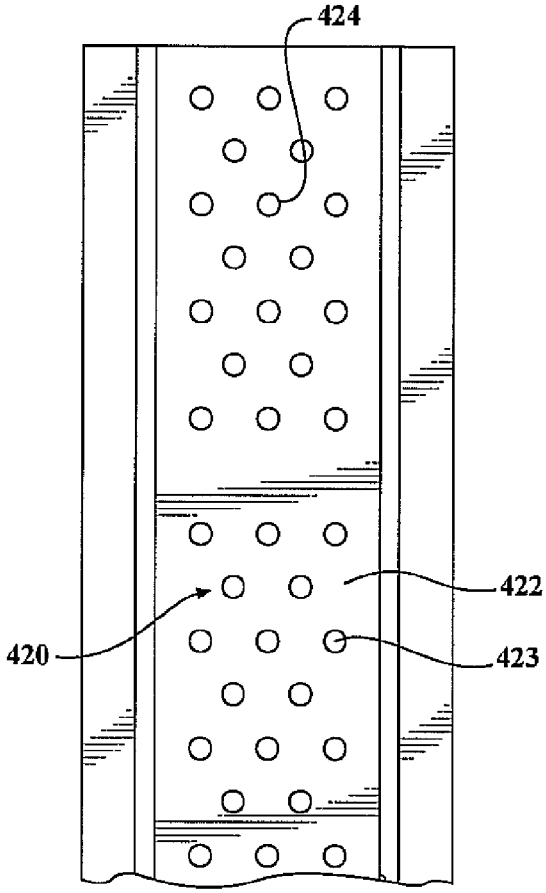
Figure 6:
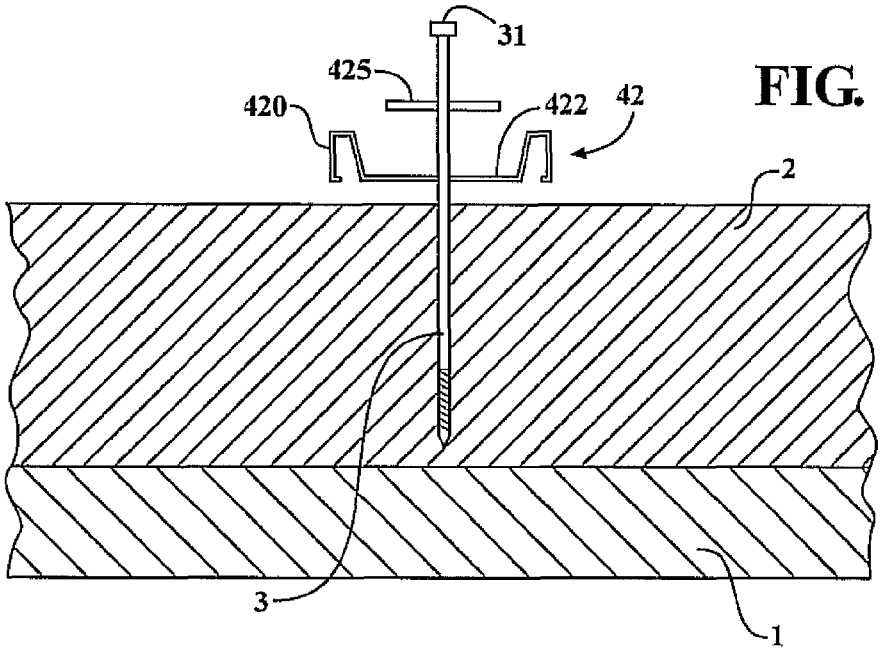
Figure 7:
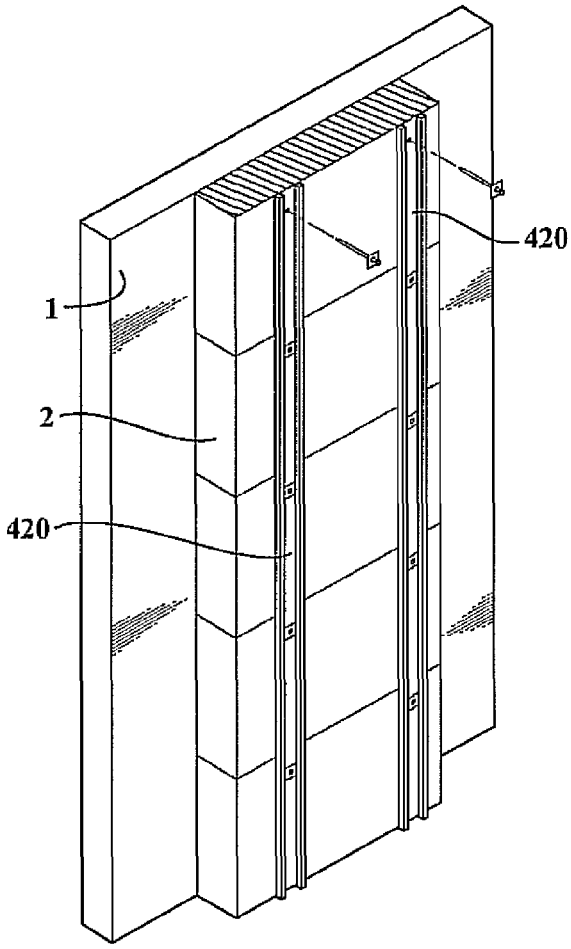
Figure 8:
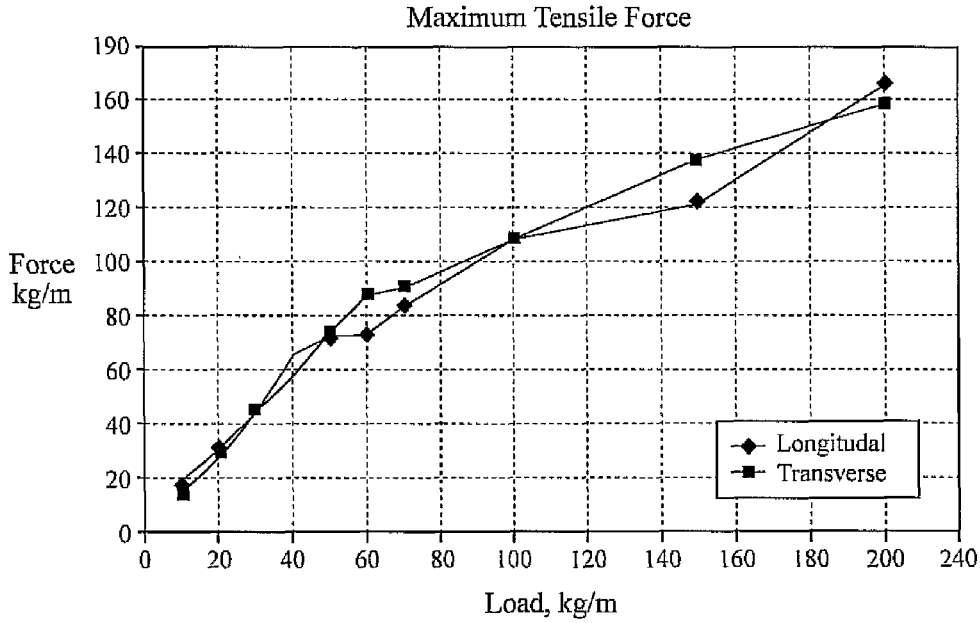
Figure 9:
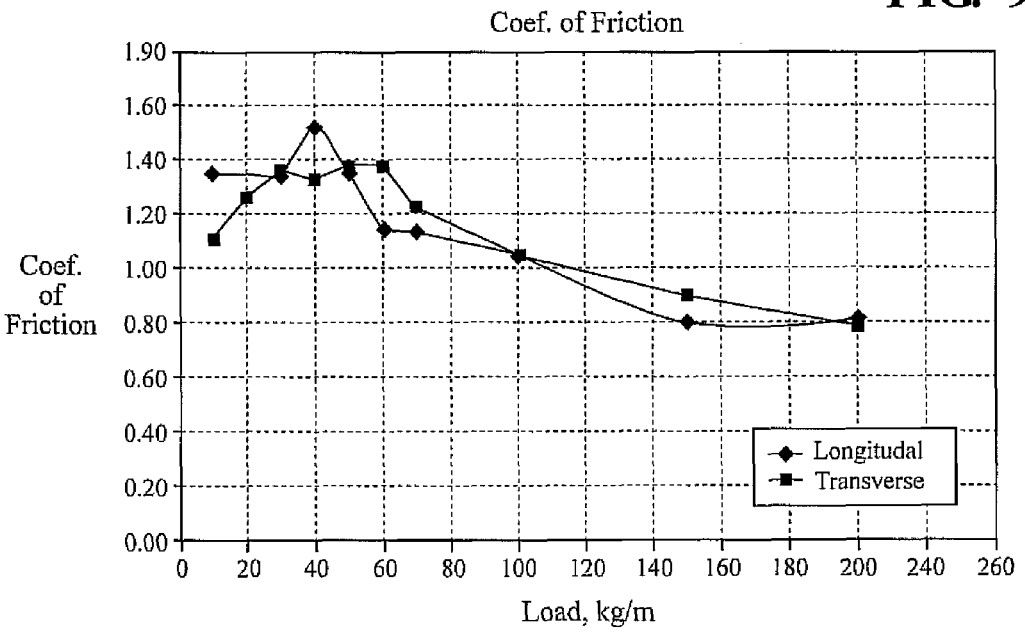

FIG. 3 is a schematic top view of a support profile according to a second embodiment of the invention, FIG. 4 is a cross-section thereof, FIG. 5 is a detailed view of the profile of FIG. 3, FIG. 6 is a schematic exploded cross-section view of a wall system according to the second embodiment of the invention, FIG. 7 is a schematic perspective view of a wall system according to an embodiment of the invention;

FIG. 8 is a diagram showing the relation between the maximum friction force and the load by a wall system according to the invention; and FIG. 9 is a diagram showing the relation between the coefficient of friction and the load by a wall system according to the invention.

Figure 1:
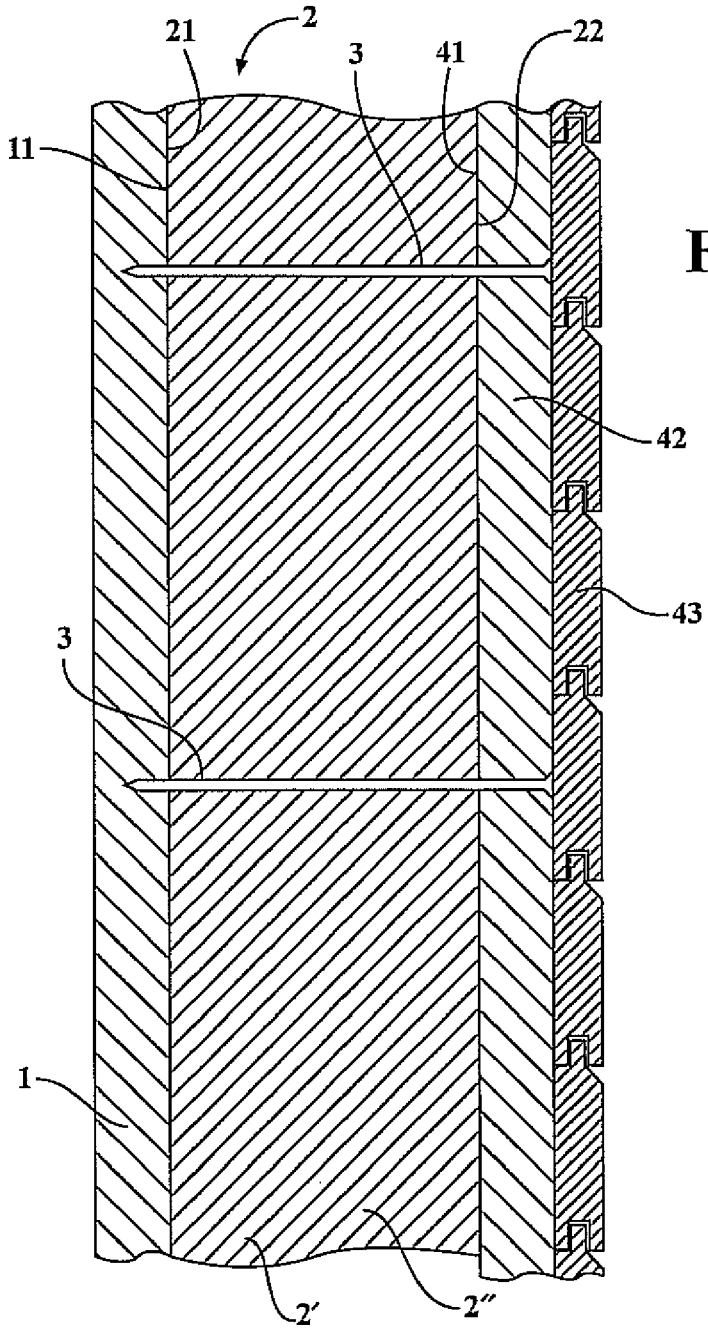
FIG. 1 is a schematic cross-section detailed view of a wall system according to an embodiment of the invention.

FIG. 1 shows a wall system according to an embodiment of the invention. According to FIG. 1, a first wall 1 is provided, said first wall being an inner wall in the present embodiment. On the outside surface 11 of this inner wall 1, slabs of fibrous insulation 2 are provided, and this insulation material 2 is fixed to the inner wall 1 by a number of fastening members 3 which are mounted through an outer wall support member 42 of the outer wall 4 and through the insulation 2. The second wall 4, in the present embodiment the outer wall 4, further includes an external wall cover 43 which may be facade panels or wooden cover or the like, which are mounted on the preferably vertically disposed elongated support members 42.

In the example shown in FIG. 1, a wooden wall structure is shown. However, it is realised that other materials may be used without departing from the scope of the invention.

In order to meet predetermined heat insulation requirements of a specific wall structure, one or more layers of insulation material 2 may be provided. As an example, two layers of insulation material 2', 2" are shown in FIG. 1.

The fastening members 3 are screws which are mounted with pre-stressed, i.e. with a permanent tension load provided in the screws 3 deriving from a compression of the insulation material 2 and the elastic properties of such material.

Figure 2:
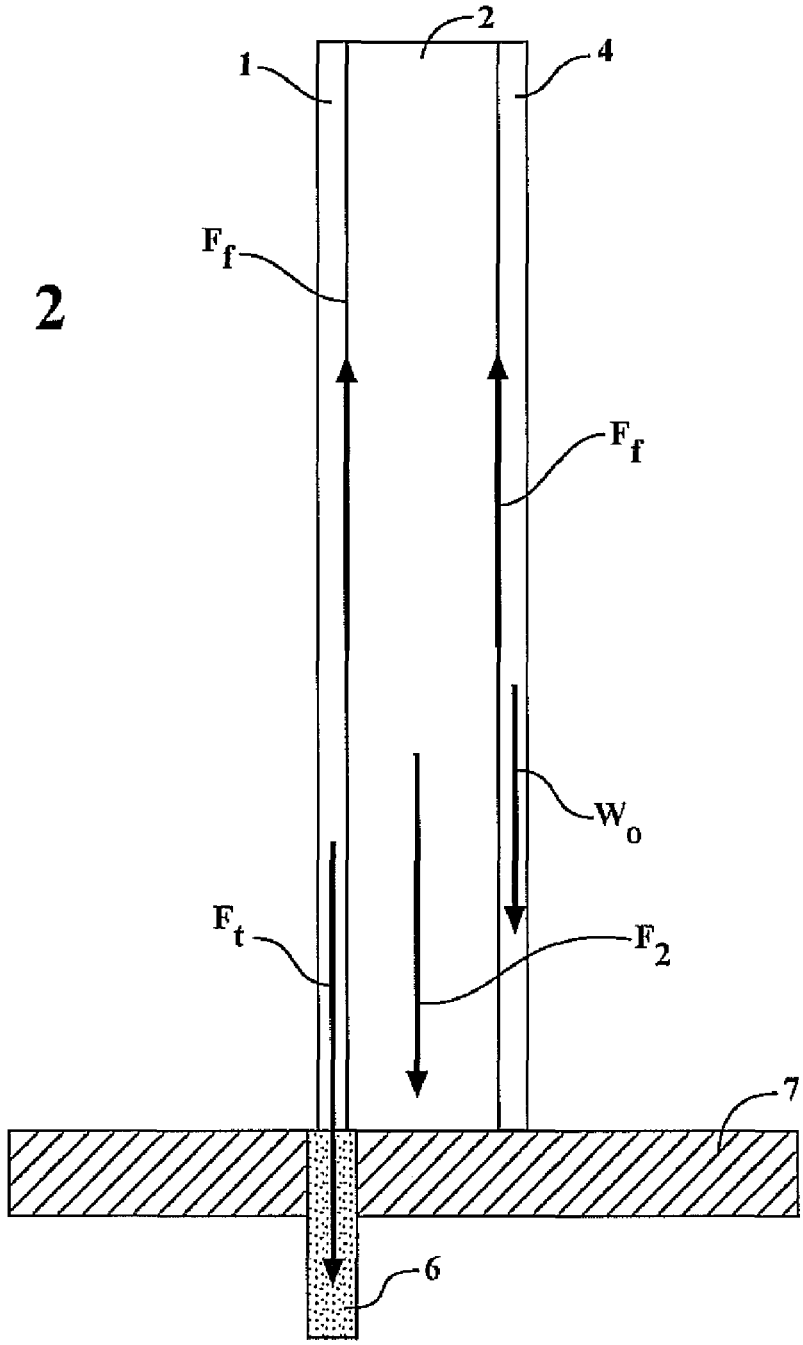
FIG. 2 is a schematic view of a wall system according to the invention illustrating the distribution of forces.

As a result of the permanent tension in the fastening screws 3, a normal force $F_n$ is created between the outer surface 22 of the insulation material 2 and the inner surface 41 of the outer wall structure 4. The same normal force is also created between the inner surface 21 of the insulation material 2 and the external surface 11 of the inner wall 1. This means that a friction force $F_f$ is established whereby the load $W_o$ of the outer wall 4 is transferred to the inner wall 1, which—as shown in FIG. 2—is mounted on a building foundation 6 in the ground 7. Hereby, the weight $F_t$ of the entire wall system is transferred to the foundation through the inner wall. In other circumstances, the weight and the load of the insulation material $F_i$ may be transferred to the foundation (not shown in FIG. 2) if the foundation is dimensioned to extend beneath the insulation, and the insulation is mounted resting on the foundation 6.

By a wall system according to the invention, the required size of the foundation may be reduced and a thermal bridge through the foundation may be avoided or at least reduced by a wall system according to the invention.

In FIGS. 3 to 6, a second embodiment of the invention is shown. In this embodiment, a metal profile 420 is provided as support member 42 in the wall system. This profile 420 is advantageous as it is made from a fire-proof material, in particular steel, preferably corrosion-resistant steel, galvanised steel or the like. The profile 420 is formed with a central insulation engagement portion 422 and two building cover structure receiving surfaces 421 on each side of the central portion 422. The building cover receiving surfaces 421 are formed in a plane parallel with the central insulation abutting portion 422 and as shown in FIG. 4 connecting portions 426 are formed which are formed as a bend in the sheet material with respect to the central portion 422, which provides extra stiffness to the profile 420. On the outside of the building cover receiving surfaces 421 outer portions 427 which are substantially perpendicular to the building cover receiving surfaces 421. The particular cross-sectional shape of the profile 420, as shown in FIG. 4, provides the profile with a stiffness that ensures an even distribution of the friction forces when the profile 420 is mounted in the wall system sandwiching the insulation material 2 between the profile 420 and the first wall 1. The profile 420 is formed with a specific shape providing sufficient stiffness so that the profile 420 does substantially not bend along its longitudinal axis when fitted by pre-stressed fasteners 3. In the central portion 422 of the profile 420 there is provided mounting holes 424 and friction enhancing knobs such as an array of rearwardly extending embossings 423. By the profile 420 a uniform contact between the profile 420 and the insulation 2 (see FIG. 7).

With reference to FIG. 6, to further ensure the even distribution of the pre-determined compression of the insulation material 2, disks 425 are mounted over the mounting holes 424 so the tension of the fasteners 3 is transferred via the fastener heads 31 to the disks 425 and onto the central portion 422 of the profile 420. The disks 425 are of a size covering a substantial portion around the mounting holes 424. The profiles 420 are preferably made in a steel plate material with a thickness of 0.5-2 mm and the thickness of the corresponding disks is preferably 2-5 mm.

By this embodiment it is advantageously ensured that the required number of mounting holes, i.e. fastening points is determined by the wind load on the building structure and not primarily in order to establish the required friction. It is found that the required friction may be established with relative few fastening points.

The insulation material may be foam or mineral fibre wool. Further, it is found that two layers of insulation material 2',2" may be fitted in a wall system according to the invention. In a preferred embodiment, the insulation material 2 may be mineral fibre wool with a density of 50 to 150 kg/(3.12 to 9.36 lb/ft$^3$), more preferably 70 to 150 kg/m$^3$ (4.36 to 9.36 lb/ft$^3$), most preferably approx. 100 kg/m$^3$ (6.24 lb/ft). It is found advantageous that the hardness of the surface of the mineral fibre wool is relative hard. Accordingly, in a preferred embodiment, the surface area e.g. the outermost 20 mm of the mineral fibre bats, is provided with a higher density, e.g. 180 kg/m$^3$ (11.23 lb/ft).

The second wall 4 is mounted either directly or indirectly onto the profiles 420 constituting the support members 42 in the wall system. By a wall system according to this second embodiment, the load carrying capability is sufficiently high enabling the system according to the invention to carry wooden, concrete, stone tiles or other building cover materials, i.e. a load of up to 80-100 kg/m$^2$ (16.4-20.5 lb/ft$^2$).

With reference to FIG. 7, the wall 1 is supplied with a layer of insulation 2 which is mounted onto the outer side of the wall 1 by a number of support profiles 420 which are secured to the wall 1 by fasteners pierced through the insulation 2 and mounted with a predetermined amount of tension thereby slightly compressing the insulation 2 and establishing a frictional force between the wall 1 and the insulation 2 and between the insulation 2 and the profiles 420. The profiles 420 are moreover designed for supporting the outer skin of the building, i.e. the outer wall structure (not shown in FIG. 7).

EXAMPLE 1

In order to determine the friction forces which might be obtained, tests for measuring the friction was set up. It was the object to determine the friction coefficient as well as measuring the normal forces that are obtainable by compression, i.e. deformation, of the insulation material.

The wall system used for the test included a wooden inner wall and vertical wooden beams with a wooden outer cover fixed to the beams. The insulation between the inner and outer wall was a fibrous mineral insulation with a density of 70 kg/m$^3$ (4.36 lb/ft$^3$) and a thickness of 250 mm (10 inches).

The normal force $F_n$, i.e. the force that determines the friction force F between the walls and the insulation by the equation:

$$F_f=F_n\times\mu,$$

where the friction force $F_f$ equals the load of the facade, i.e. the outer all cover;

the normal force $F_n$ is established by the tension load on the pre-stressed fastening screws; and $\mu$ is the static coefficient of friction of the materials and the surface textures of the materials involved, i.e. the insulation material and the wall material.

The friction coefficient was found to be $\mu$=0.55 with a variation of 0.04.

The measurements illustrating the relationship were found between the deformation of the fibrous insulation slap and the normal force $F_n$ are listed in table 1, see below.

TABLE 1

| Deformation [mm] | Proportional deformation | Normal force [kN/m] |
|---|---|---|
| 0 | 0% | 0 |
| 1 | 0.4% | 0.1 |
| 2 | 0.8% | 0.27 |
| 3 | 1.2% | 0.41 |
| 4 | 1.6% | 0.6 |
| 5 | 2.0% | 0.8 |
| 6 | 2.4% | 1 |
| 7 | 2.8% | 1.2 |
| 8 | 3.2% | 1.38 |
| 9 | 3.6% | 1.5 |
| 10 | 4.0% | 1.7 |
| 20 | 8% | 2.75 |
| 40 | 16% | 3.85 |
| 60 | 24% | 4.45 |
| 80 | 32% | 5 |
| 100 | 40% | 5.4 |

In accordance with the measurements in table 1, it is found that a sufficient friction force may be established by a compressing of the 250 mm (10 inch) thick insulation approx. 3-8 mm 0.12-0.31 inch) and more preferably a compression between 4-6 mm (0.16-0.24 inch) for a 250 mm (10 inch) insulation thickness. This corresponds to a proportional springy compression of 1.2-3.2%, more preferably 1.6-2.4%. Hereby, a sufficient friction force is achieved by a relatively small compression so that the insulation effect is not compromised.

For practical calculation purposes, the value of the coefficient of friction between fibrous insulation material and a wooden surface may be set to $\mu$=0.5, resulting in a friction force of approximately half of the normal force. The friction may be increased depending on the texture of the surface of the wall. The surface texture may be manipulated for this purpose by e.g. providing a rough surface, a coating material, such as a special paint or a coating of the outer wall member 42 of e.g. a rubber material, tape, plastic or even glue, etc. In any case, the tension of the fastening screws 3 is of a predetermined value sufficiently high to establish the required friction forces to carry the outer wall structure 4. By providing a friction enhancing surface manipulation of the wall surfaces 11, 41, the required tension in the screws 3 may be reduced.

EXAMPLE 2

In order to determine the friction forces between mineral fibre insulation material and a steel profile as shown in FIGS. 3 to 6, a test for measuring the friction was set up. It was the object to determine the friction coefficient as well as measuring the required tensile forces in the longitudinal direction and in the transverse direction of the profile in order to cause displacement of the profile.

Two test setups were used: (1) Tensile force directed in the longitudinal direction of the bats, (2) tensile force in the transverse direction of the bats. The weights are placed equally spaced on the section steel profile bar to simulate the effect of the pre-stressed fasteners according to the invention. The bats were secured against displacement. The section steel profile was connected to a load transducer and a hydraulic cylinder. An electronic displacement transducer was used to measure the displacement of the board. The transducers are connected to an amplifier and a PC for data acquisition.

The tensile force necessary to move the board versus the displacement was measured for different loads in both the transverse and the longitudinal direction. Table 2 below shows the maximum tensile force for different loads:

TABLE 2

| Load | Maximum tensile force [kg/m] | |
|---|---|---|
| [kg/m] | Longitudinal | Transverse |
| 10 | 19.3 | 15.9 |
| 20 | 32.7 | 30.7 |
| 30 | 45.8 | 46.7 |
| 40 | 67.4 | 58.9 |
| 50 | 73.0 | 74.5 |
| 60 | 73.6 | 88.8 |
| 70 | 83.9 | 91.4 |
| 100 | 108.0 | 109.0 |
| 150 | 122.0 | 137.0 |
| 200 | 165.0 | 158.0 |

The coefficient of friction is calculated as:

$$\mu=H/(V+G),$$

where:

H is measured tensile force [in kg]

V is the load [in kg]

G is the weight of steel profile [in kg]

From the tensile forces the maximum coefficient of friction are calculated as shown in table 3.

TABLE 3

| Load | Coefficient of friction - μ | |
|---|---|---|
| [kg/m] | Longitudinal | Transverse |
| 10 | 1.36 | 1.12 |
| 20 | 1.35 | 1.27 |
| 30 | 1.34 | 1.36 |
| 40 | 1.52 | 1.33 |
| 50 | 1.35 | 1.37 |
| 60 | 1.15 | 1.38 |
| 70 | 1.13 | 1.23 |
| 100 | 1.04 | 1.05 |
| 150 | 0.79 | 0.89 |
| 200 | 0.81 | 0.77 |

The measured and calculated results of tables 2 and 3 are shown graphically in FIGS. 8 and 9.

As it is apparent from FIG. 9, the calculated coefficient of friction on the basis of the measured test results ranges from approx. 0.77 to 1.52 and the friction between the mineral fibre wool and the profile is similar for both the transverse and the longitudinal directions.

Above, the invention is described with reference to a vertical side wall structure. However, by the invention, it is realised that other wall structures may be provided with prestressed tension screws as prescribed by the invention. Examples thereof could be a roof structure. The wall system may also be used for internal walls in a building structure, where a partitioning wall must be provided with heat, sound and/or fire insulation.

The invention claimed is:

1. An insulating wall system for a building structure, said wall system comprising a first, outer wall having an exterior surface disposed in a vertical orientation, with insulation material attached to said exterior surface of said first wall in said vertical orientation by fastening members extending substantially perpendicular to the exterior surface through at least one support member of a second wall and the insulation material and being fixed to the first wall, wherein the substantially perpendicular fastening members are mounted pre-stressed with a predetermined amount of tension by compressing the insulation material so that frictional forces between the insulation material and the exterior surface of the first wall and between the insulation material and the inner surface of the support member, respectively, are established, wherein the at least one support member is a metal profile having mounting surfaces for carrying the building cover, and wherein the metal profile is provided with an insulation engaging portion having a friction enhancing surface comprising an array of rearwardly extending and spaced apart embossings, each embossing comprising a knob, said knobs being disposed so as to directly abut and engage the insulation material so as to create discrete, minor compressions in the surface thereof, said profile further including at least one or more building cover structure receiving surfaces disposed opposite of said insulation engaging portion.

2. The wall system according to claim 1, wherein the second wall includes one or more elongated support members and a building cover structure mounted on said one or more elongated support members.

3. The wall system according to claim 1, wherein the at least one support member is a steel profile having mounting surfaces for carrying the building cover.

4. The wall system according to claim 1, wherein the friction enhancing surface is provided on a central portion of the profile together with a plurality of mounting holes provided therein.

5. The wall system according to claim 1, wherein the predetermined amount of tension is a factor 1.5 to 3 greater than the size of the friction forces.

6. The wall system according to claim 1, wherein the insulation material is compressed and thereby providing the prestressed mounting of the fastening members, said compression being between 1.2% and 3.2%.

7. The wall system according to claim 1, wherein the elongated fastening members are screws.

8. The wall system according to claim 1, wherein the insulation material includes at least one layer of insulation boards.

9. The wall system according to claim 1, wherein the insulation material is mineral fibre boards having a density of 3.12 to 9.36 lb/cu ft (50 to 150 kg/m$^3$).

10. The wall system according to claim 1, wherein at least one of the insulation board layers include dual density mineral fibrous boards.

* * * * *